US006394425B1

(12) United States Patent
Nagata

(10) Patent No.: US 6,394,425 B1
(45) Date of Patent: May 28, 2002

(54) CARBURETOR WITH A ROTARY THROTTLE VALVE

(75) Inventor: Noriyu Nagata, Miyagi (JP)

(73) Assignee: Walbro Japan, Inc., Tokyo (JP)

( * ) Notice: Subject to any disclaimer, the term of this patent is extended or adjusted under 35 U.S.C. 154(b) by 0 days.

(21) Appl. No.: 09/561,466

(22) Filed: Apr. 28, 2000

(30) Foreign Application Priority Data

May 6, 1999 (JP) ..... 11-125612

(51) Int. Cl.[7] ..... F02M 9/08
(52) U.S. Cl. ..... 261/44.8; 29/890.122
(58) Field of Search ..... 261/44.3, 44.6, 261/44.8, 50.1, 51, 62; 29/890.122

(56) References Cited

U.S. PATENT DOCUMENTS

| | | | | | |
|---|---|---|---|---|---|
| 2,062,496 | A | * | 12/1936 | Brokel | 261/44.3 |
| 3,698,367 | A | * | 10/1972 | Goodwin | 261/62 X |
| 3,985,839 | A | * | 10/1976 | Edmonston | 261/44.3 |
| 4,481,152 | A | * | 11/1984 | Kobayashi et al. | 261/44.8 X |
| 4,481,153 | A | * | 11/1984 | Kobayashi et al. | 261/44.8 X |
| 5,599,484 | A | * | 2/1997 | Tobinai | 261/44.8 X |
| 5,709,822 | A | * | 1/1998 | Togashi | 261/44.8 X |
| 5,942,160 | A | * | 8/1999 | Araki | 261/44.8 |

FOREIGN PATENT DOCUMENTS

| | | | | |
|---|---|---|---|---|
| FR | 526133 | | 10/1921 | |
| JP | 60019969 | | 2/1985 | |
| JP | 6129303 | | 5/1994 | 261/44.3 |
| JP | 6-129303 | * | 5/1994 | 261/44.3 |

* cited by examiner

*Primary Examiner*—Richard L. Chiesa
(74) *Attorney, Agent, or Firm*—Reising, Ethington, Barnes, Kisselle, Learman & McCulloch, PC

(57) ABSTRACT

A rotary throttle valve type carburetor including an air intake passage extending through a carburetor body, a cylindrical valve chamber formed perpendicularly to the air intake passage, a throttle valve inserted into the valve chamber, and a throttle valve lever which rotates to impart rotation and axial movement to the throttle valve to thereby regulate the amount of air and fuel drawn through the carburetor. A plurality of circumferentially extending cam surfaces are formed on a bottom face of the throttle valve symmetrical with respect to the axis of the throttle valve, while tapered bores for receiving balls which are adapted to engage with the cam surfaces are formed in a bottom face of the valve chamber. The sliding engagement between the cam surfaces and balls due to rotation of the throttle valve is adapted to provide a predetermined axial movement of the throttle valve. Desirably, a columnar-shaped fitting jig is inserted into the valve chamber to press-fit the balls into the tapered bores so that the balls are disposed at a common height in the valve chamber.

10 Claims, 2 Drawing Sheets

CARBURETOR WITH A ROTARY THROTTLE VALVE

REFERENCE TO RELATED APPLICATIONS

Applicant claims the priority of Japanese patent application, Ser. No. 11-125612, filed May 6, 1999.

FIELD OF THE INVENTION

The present invention relates to a carburetor and more particularly to a rotary throttle valve type carburetor.

BACKGROUND OF THE INVENTION

Recently, even for portable working machines such as lawn mowers, chainsaws, and the like, increasingly strict gas emission regulations have been promulgated. An engine in such a portable working machine is usually provided with a closed type carburetor which may be operated in substantially any orientation without any fuel leakage while maintaining a sufficient supply of fuel to the engine. However, to comply with the emission control regulations, a carburetor which is excellent in durability and stable in fuel supply so that the amount of fuel does not change over time is required.

In the rotary throttle valve type carburetor disclosed in Japanese Utility Model Publication No. 60-19969, a cam groove formed in a lower face of a throttle valve lever connected to a valve shaft is engaged with a ball supported by an upper wall of the carburetor body so as to cover the ball. Accordingly, dust particles or other foreign particles or contaminants rarely enter the carburetor from the exterior, and smooth movement of the ball is assured. However, even in the above-described structure, an engaged part between the ball in the carburetor body and the cam groove in the throttle valve lever is exposed to the exterior and, therefore, there is the potential for foreign particles or other contaminants to enter the carburetor or foul these components. Especially when the foreign particles are stuck between the ball and the cam groove while the machine is not in use for a long period of time, smooth operation is hindered and the amount of fuel delivered from the carburetor to its engine becomes unstable. Further, the ball and the cam groove are likely to wear because they are engaged with each other only at one point. The throttle valve lever is always employed and actuated with a bending force, and over time, bending or inclination of the throttle valve lever can occur which causes a corresponding change in the amount of fuel delivered from the carburetor. Further, because the cam groove is integral with the throttle valve lever, the shape of the throttle valve lever cannot be freely altered.

In view of the above drawbacks, there is a present need in the art for a carburetor which provides smooth and stable operation, with a constant amount of fuel supplied to its engine over time and which has excellent durability.

SUMMARY OF THE INVENTION

A rotary throttle valve type carburetor has a carburetor body with an air intake passage, a cylindrical valve chamber formed perpendicularly to the air intake passage, a throttle valve inserted into the valve chamber, and a throttle valve lever which moves and rotates to impart rotation and axial movement to the throttle valve to regulate the flow of fuel and air in the carburetor. The carburetor according to the present invention is characterized in that a plurality of circumferentially extending cam surfaces are formed on the bottom face of the throttle valve generally symmetrical with respect to the axis of the throttle valve, while tapered bores for receiving balls which are adapted to engage with the cam surfaces are formed in the bottom face of the valve chamber. To facilitate assembly, a columnar-shaped fitting jig is inserted into the valve chamber to accurately press-fit the balls into the tapered bores.

Objects, features, and advantages of the present invention include providing a rotary throttle valve type carburetor which provides a consistent and stable fuel supply to an engine over time, resists the entry of contaminants into the carburetor, permits accurate assembly and operation even with errors in or differences between the various balls and tapered bores, provides a simple fitting jig to accurately and consistently press-fit the balls into the tapered bores, is rugged, durable, reliable, of relatively simple design and economical manufacture and assembly and has a long, useful life.

BRIEF DESCRIPTION OF THE DRAWINGS

These and other objects, features, and advantages of this invention will be apparent from the following detailed description of the preferred embodiment and best mode, appended claims, and accompanying drawings in which:

DETAILED DESCRIPTION OF THE PREFERRED EMBODIMENT

Figure 1:
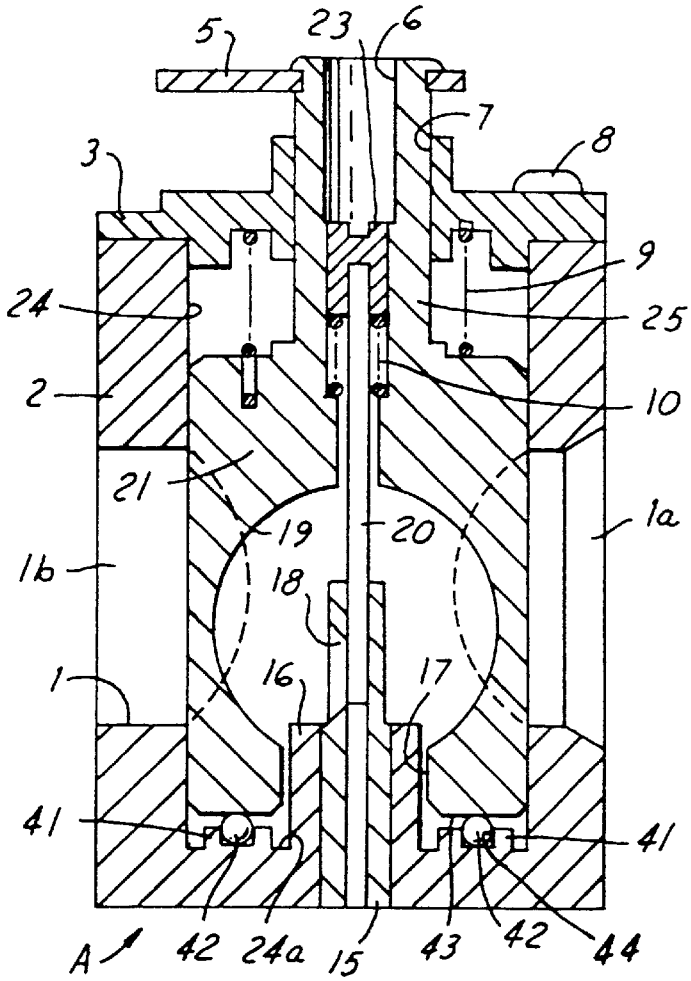
FIG. 1 is a sectional front view of a rotary throttle valve type carburetor according to the present invention.

As shown in FIG. 1, the rotary throttle valve type carburetor according to the present invention includes an air intake passage 1 of a cylindrical shape which passes transversely through a block-like carburetor body 2. An air purifier (not shown) is connectable to one end 1*a* of the air intake passage 1. The other end 1*b* of the air intake passage 1 communicates with an air intake port of an engine (not shown) through a heat insulating pipe. The carburetor body 2 is provided with a valve chamber 24 which is open at its upper end and which traverses the air intake passage 1. A cylindrical throttle valve 21 is rotatable and vertically movable and is received in part inside the valve chamber 24. The upper end of the valve chamber 24 is closed with a lid 3 which is fastened to the carburetor body 2 by way of a plurality of bolts or screws 8. A hollow valve shaft 25, formed in an upper end part of the throttle vale 21, is rotatably supported in a bore 7 through the lid 3.

At the center of a bottom face 24*a* of the valve chamber 24 in the carburetor body 2, a tubular projection 16 is provided which is engaged with a fuel nozzle 15 received therein. The throttle valve 21 includes a throttle bore 19 which communicates with the air intake passage 1. The tubular portion 16 and the fuel nozzle 15 received therein are inserted into an axial bore 17 formed in the lower end of the throttle valve 21 opening into the throttle bore 19. A coil spring 9 is interposed between the lid 3 and the upper end of the throttle valve 21 surrounding the valve shaft 25. One end of the coil spring 9 is in contact with the throttle valve 21, and the other end thereof is in contact with the lid 3. The coil spring 9 presses the throttle valve 21 toward a cam mechanism A, which will be described below, to force the throttle valve 21 to rotate in a direction of throttling the air intake passage 1.

A spring 10 is contained in a hollow part 6 of the valve shaft 25. A bolt 23, screwed in the hollow part 6 against the force of the spring 10, is connected with a needle 20. The needle 20 is inserted into the fuel nozzle 15, extends transverse to the throttle bore 19, and controls the opening degree of a fuel jet 18 which is formed in a peripheral wall of the fuel nozzle 15.

Figure 2:
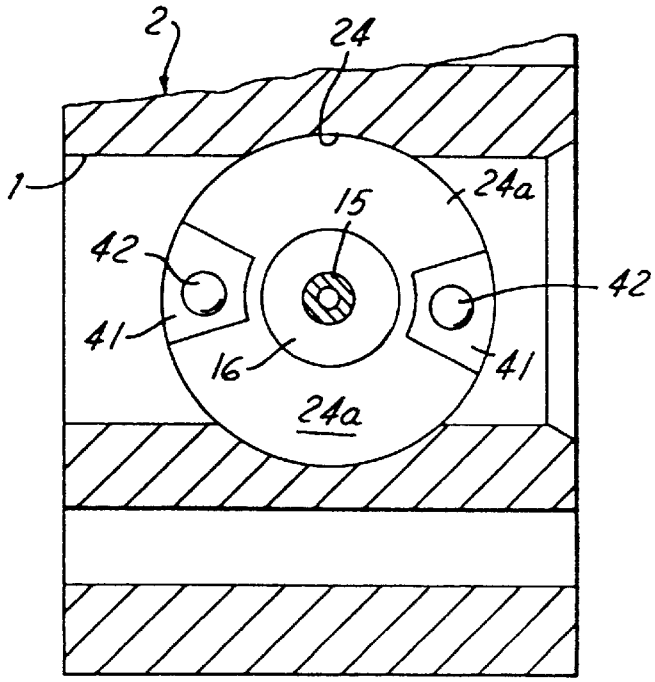
FIG. 2 is a sectional plan view of the rotary throttle valve type carburetor.
Figure 3:
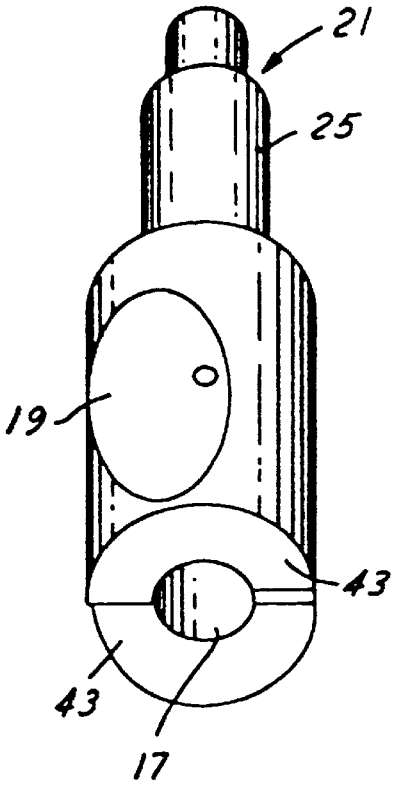
FIG. 3 is a perspective view of a throttle valve of the rotary throttle valve type carburetor.

According to the present invention, the cam mechanism A is provided for imparting axial movement to the throttle valve 21 in association with the rotation of the throttle valve 21. The cam mechanism A consists of hard balls 42 fitted in tapered bores 44 in a plurality of platforms 41 provided on the bottom face 24*a* of the valve chamber 24, as shown in FIG. 2, and a plurality of cam surfaces 43 provided on the bottom face of the throttle valve 21, as best shown in FIG. 3. The cam surfaces 43, inclined in a circumferential direction at the bottom face of the throttle valve 21, are formed generally symmetrical with respect to the axis of the throttle valve 21. Each platform 41 is provided with a tapered bore 44 which receives a ball 42 adapted to engage with a respective cam surface 43.

Figure 5:
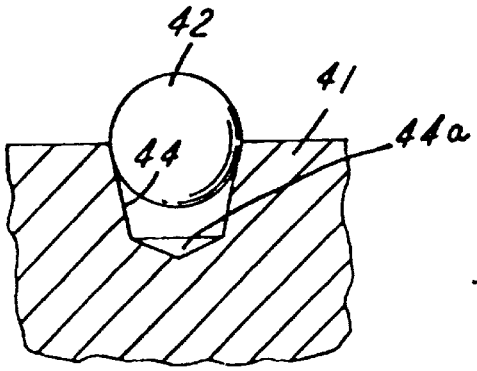
FIG. 5 is an enlarged fragmentary sectional view of a tapered bore with a ball therein which supports part of the throttle valve of the carburetor.

As shown in FIG. 5, each of the tapered bores 44 for supporting a ball 42 is formed with a small tapered angle, and a bottom part 44*a* of the tapered bore 44 may be in substantially the same shape as a bottom hole formed with an ordinary drill. The depth of the tapered bore 44 must be amply deeper than the radius of the balls 42.

Figure 4:
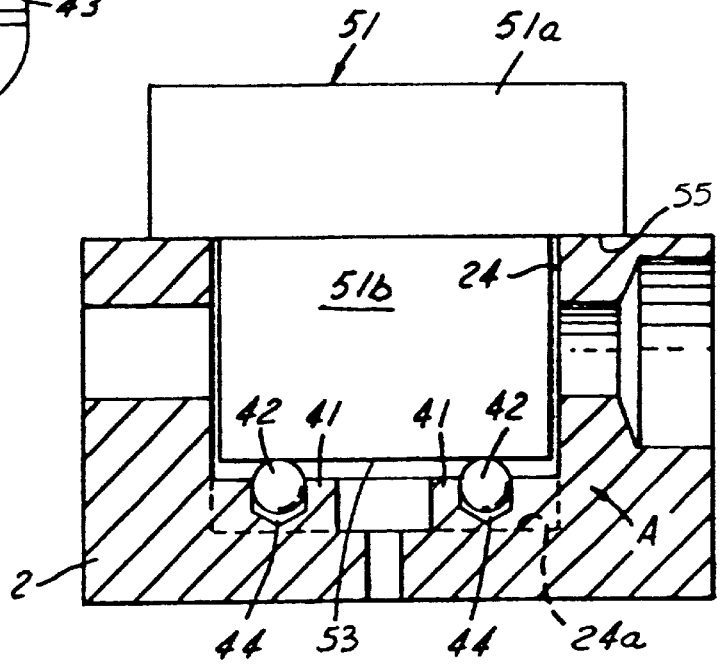
FIG. 4 is a sectional front view of a carburetor body of the rotary throttle valve type carburetor.

As shown in FIG. 4, the balls 42 are press-fitted in the respective tapered bores 44 by way of a flat bottom face 53 of a columnar-shaped fitting jig 51 which is inserted into the valve chamber 24. The fitting jig 51 has a shaft portion 51*b* with an outer diameter which is substantially equal to the inner diameter of the valve chamber 24 and a length slightly shorter than the axial length of the valve chamber 24 and a flange 51*a* at its end defining an annular shoulder which overlies a portion of the carburetor body 2. The length of the shaft portion 51*a* is controlled so that the flange 51*a* of the fitting jig 51 bears on or engages the upper face of the carburetor body 2 when the balls 42 are press-fitted to the desired depth in the tapered bores 44. The bottom face 53 of the jig 51 and the shoulder 55 defined by the flange 51*a* are perpendicular to an axis of the valve chamber 24. So constructed, after being press-fitted into the bores 44, an uppermost point of each ball 42 lies in a common plane perpendicular to the axis of the valve chamber 24.

In order to hold a pair of the balls 42 at the same level or height in the valve chamber 24, the balls 42 are placed into the tapered bores 44, and then the shaft portion 51*b* of the fitting jig 51 is inserted into the valve chamber 24 to press-fit the left and right balls 42 into the tapered bores 44 by way of the bottom face of the shaft portion 51*b*. When the flange shoulder 55 has come into contact with the upper face of the carburetor body 2, the balls 42 are slightly or partially press-fitted in the tapered bores 44, but do not reach the bottoms of the tapered bores 44. Since a pair of the balls 42 are equally pressed by means of the bottom face 53 of the fitting jig 51, with the uppermost point of each ball 42 lying in a plane at least essentially perpendicular to the axis of the valve chamber 24, the balls 42 are supported at the same level or height in the valve chamber 24. Accordingly, when the throttle valve 21 is inserted into the valve chamber 24, a pair of the cam surfaces 43 formed on the bottom face of the throttle valve 21 equally contact the balls 42, leaving no gap therebetween. Therefore, the problems associated with machining errors or large tolerances of the balls 42 or the tapered bores 44, such as the throttle valve 21 being inclined with respect to the valve chamber 24 or one of the balls 42 not coming into contact with the cam surface 43, are avoided with the present invention because the tops or uppermost point of the balls 42 are disposed at the same height in the valve chamber 24, regardless of the size of the balls 42 or the depth or size of the bores 44.

Desirably, a pair of symmetrical cam surfaces 43 are provided and a pair of balls 42 are provided equally radially spaced from the axis of the throttle valve 21 and centered on a line extending perpendicular to and intersecting the axis of the throttle valve 21 (i.e., diametrically opposed). This arrangement provides a uniform engagement of each cam surface 43 with its associated ball 42 to impart a smooth, balanced rotational and axial movement of the throttle valve 21.

When the throttle valve 21 is driven to rotate by way of a throttle valve lever 5 fastened to the upper end of the valve shaft 25, the passage area of the throttle bore 19 communicating with the air intake passage 1, that is, the opening degree of the throttle valve 21, is increased. Simultaneously, the cam surfaces 43 move along the balls 42 according to a rotated angle of the throttle valve 21 to impart the axial movement to the throttle valve 21. This axial movement of tie throttle valve 21 moves the needle 20 relative to the fuel nozzle 15 to increase the opening degree of the fuel jet 18, and, thus, the amount of fuel drawn from the fuel jet 18 into the throttle bore 19 is increased.

During operation of the rotary throttle valve type carburetor, the throttle valve 21 moves up and down while rotating to control the amount of air and fuel drawn through the carburetor. The cam mechanism A for imparting axial movement to the throttle valve 21 is disposed between the bottom face 24*a* of the valve chamber 24 in the carburetor body 2 and the bottom face of the throttle valve 21 inserted in the valve chamber 24 so as to prevent foreign particles or the like from entering from the exterior and sticking and fouling the carburetor components. The cam mechanism A consists of the cam surfaces 43, provided on the bottom face of the throttle valve 21, and the balls 42, supported by the bottom face 24*a* of the valve chamber 24 of the carburetor body 2 and adapted to engage with the cam surfaces 43.

The rotation of the throttle valve 21 is effected only by way of the throttle valve lever 5, while the axial movement of the throttle valve 21 is effected by way of a plurality of the cam surfaces 43 arranged on the bottom face of the throttle valve 21. In order to align the level or height of engagement of the circumferentially arranged cam surfaces 43 and the balls 42, the fitting jig 51 is inserted into the valve chamber 24 of the carburetor body 2, and a plurality of the balls 42 are simultaneously press-fitted into the respective tapered bores 44. The depth of insertion of the balls 42 into the tapered bores 44 is restricted when the flange 51*a* of the fitting jig 51 contacts the upper face of the carburetor body 2.

More particularly, the balls 42, adapted to engage with a plurality of the cam surfaces 43 formed on the bottom face of the throttle valve 21, are press-fitted into the tapered bores 44 formed in the bottom face 24*a* of the valve chamber 24 by way of the fitting jig 51 inserted into the valve chamber 24. Accordingly, the balls 42 are supported at the same level or height in the tapered bores 44, and the cam surfaces 43 of the throttle valve 21 are equally engaged with the balls 42. Therefore, a so-called one side contact in which only one of the cam surfaces 43 comes in contact will be avoided.

Therefore, because the cam surfaces 43 and the balls 42 constituting the cam mechanism A for axially moving the throttle valve 21 are disposed below the throttle valve 21, and within the carburetor body 2, foreign particles are prevented from entering from the exterior to improve the durability of the cam mechanism A. Additionally, the cam surfaces 43 and the balls 42 enable the throttle valve 21 and the needle 20 to move smoothly, thus reducing wear of rotating and sliding parts of the throttle valve 21 and the valve shaft 25. Further, because a smooth motion of the throttle valve 21 can be obtained, the fuel amount delivered from the carburetor can be accurately controlled enabling deviation of the products to be reduced. Still further, because bending of the throttle valve lever 5 will not affect quantitative change of the amount of fuel delivered from the carburetor, the shape of the throttle valve lever 5 can be varied with greater freedom.

Therefore, the rotary throttle valve type carburetor has excellent durability, is stable in the amount of fuel supplied to an engine over a long period of time to maintain compliance with the emission control regulations.

I claim:

1. A carburetor comprising:

a body having an air intake passage and a cylindrical valve chamber defined within said body perpendicular to said air intake passage, said valve chamber having a bottom face with at least one tapered bore formed therein;

a throttle valve inserted into said valve chamber, said throttle valve having a bottom face with at least one circumferentially extending cam surface formed thereon, said cam surface being inclined along the circumference thereof;

a throttle valve lever capable of imparting rotation to said throttle valve;

a ball received in said at least one tapered bore of said valve chamber and adapted to engage said at least one cam surface of said throttle valve to cause, when the throttle valve rotates, axial displacement of the throttle valve with such rotational and axial movement of the throttle valve controlling flow of fuel and air through the carburetor;

the minimum diameter of each said tapered bore being smaller than the outside diameter of said ball received in said tapered bore, the depth of said tapered bore being greater than the radius of said ball received therein, and said ball being press fit into said tapered bore with a portion of its surface projecting from said tapered bore.

2. The carburetor of claim 1 wherein the throttle valve has a pair of cam surfaces and a pair of tapered bores are provided with a separate ball press-fit in each tapered bore with each ball adapted to engage a separate one of the cam surfaces.

3. The carburetor of claim 2 wherein the cam surfaces are symmetrical with respect to an axis of rotation of the throttle valve.

4. The carburetor of claim 2 wherein each tapered bore is disposed on a line perpendicular to and intersecting an axis of rotation of the throttle valve.

5. The carburetor of claim 1 wherein a plurality of cam surfaces are provided on the throttle valve and a plurality of tapered bores are provided with a separate ball press-fit in each tapered bore.

6. The carburetor of claim 2 wherein the balls are partially press-fit into their respective tapered bores so that an uppermost portion of the balls are disposed in a plane perpendicular to an axis of the valve chamber.

7. The carburetor of claim 6 wherein the balls are press-fit into their respective bores by a jig having a shaft portion with a flat bottom face perpendicular to the axis of the valve chamber and adapted to engage a ball, and a shoulder also perpendicular to the axis of the valve chamber and adapted to engage the body of the carburetor to limit the depth to which the balls are press-fit into their respective bores.

8. The carburetor of claim 7 wherein the shaft portion has a length less than the axial length of the valve chamber.

9. A method of making a carburetor comprising:

providing a carburetor body having an air intake passage and a cylindrical valve chamber within the carburetor body and perpendicular to the air intake passage with the valve chamber having a bottom face;

forming at least one tapered bore in the bottom of the valve chamber with a minimum diameter of each tapered bore being smaller than the outside diameter of a ball to be received in the tapered bore and with a depth being greater than the radius of the ball to be received therein;

press-fitting into the tapered bore a ball having an outside diameter greater than the minimum diameter of the tapered bore to retain the ball in its associated tapered bore with an interference fit and with a portion of the outer surface of the ball projecting outwardly of the tapered bore;

providing a throttle valve having a bottom face with at least one circumferentially extending cam surface with the cam surface being inclined along the circumference thereof; and inserting the throttle valve into the valve chamber so that the cam surface bears on at least the one ball received in the tapered bore of the valve chamber to cause when the throttle valve rotates axial displacement of the throttle valve with the rotational and axial movement of the throttle valve controlling the flow of fuel and air through the carburetor.

10. The method of claim 9 wherein the throttle valve has at least two tapered bores with a ball in each bore and the balls are press-fit into the tapered bores by a jig having a shaft portion with a flat bottom face perpendicular to the axis of the valve chamber and configured to engage the balls, and a shoulder perpendicular to the axis of the valve chamber configured to engage the carburetor body to limit the depth to which the balls are press-fit into their respective bores.

* * * * *